US005710483A

United States Patent [19]

Peng

[11] Patent Number: 5,710,483

[45] Date of Patent: Jan. 20, 1998

[54] FIELD EMISSION DEVICE WITH MICROMESH COLLIMATOR

[75] Inventor: Chao-Chi Peng, Chinchu, Taiwan

[73] Assignee: Industrial Technology Research Institute, Hsinchu, Taiwan

[21] Appl. No.: 629,160

[22] Filed: Apr. 8, 1996

[51] Int. Cl.[6] ..... H01J 9/02

[52] U.S. Cl. ..... 313/497; 445/24; 313/309

[58] Field of Search ..... 313/495, 496, 313/497, 309; 445/24, 25

[56] References Cited

U.S. PATENT DOCUMENTS

| | | | |
|---|---|---|---|
| 3,789,471 | 2/1974 | Spindt et al. | 29/25.17 |
| 4,763,187 | 8/1988 | Biberian | 358/56 |
| 5,063,323 | 11/1991 | Longo et al. | 313/553 X |
| 5,186,670 | 2/1993 | Doan et al. | 445/24 |
| 5,259,799 | 11/1993 | Doan et al. | 445/24 |
| 5,496,199 | 3/1996 | Makishima et al. | 445/24 X |
| 5,508,584 | 4/1996 | Tsai et al. | 445/24 X |
| 5,541,473 | 7/1996 | Duboc, Jr. et al. | 313/497 X |
| 5,621,272 | 4/1997 | Levine et al. | 313/497 X |

OTHER PUBLICATIONS

WD Kesling et al "Beam Focusing For Field Emission flat Panel Displays" IEEE Trans Elec Dev vol. 42 No. 2 Feb. 1995 pp. 340–347.

C. Py et al. "In Plane refocusing of a microtip electron beam by a surrounding ring" Tech Digest Int Vacuum Microelec Conf. 1996, pp. 171–175.

*Primary Examiner*—Kenneth J. Ramsey

*Attorney, Agent, or Firm*—George O. Saile; Stephen B. Ackerman

[57] ABSTRACT

A structure is described in which subpixel-sized electron beams are formed by extraction from field emission microtips located on cathode columns over which orthogonally disposed gate lines have been laid. After accelerating past openings in said gate lines, all electrons originating from the same subpixel are made to pass through a single micromesh whose electric potential is more negative than that of the gate. This results in said electrons becoming collimated and forming a parallel beam which diverges only slightly before it reaches the phosphor screen (anode). A process for manufacturing this structure is also described. Said process does not require that the microtips and the micromesh be carefully aligned nor does the presence of the micromesh lead to any reduction in optical resolution. The problem of minimizing stress in the micromesh is also addressed.

21 Claims, 6 Drawing Sheets

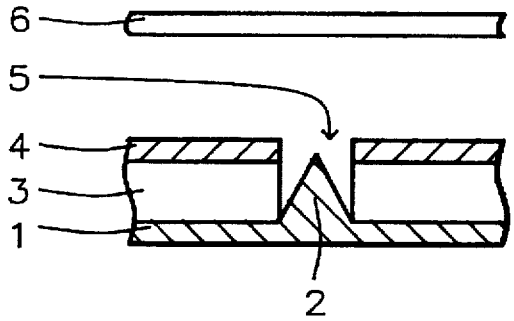
FIG. 1 – Prior Art
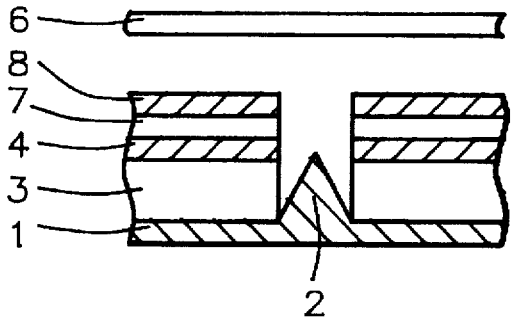
FIG. 2 – Prior Art
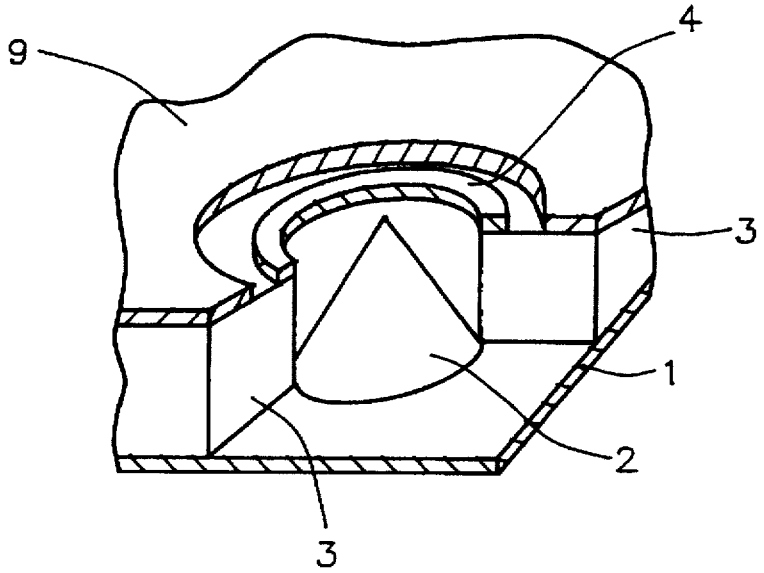
FIG. 3 – Prior Art

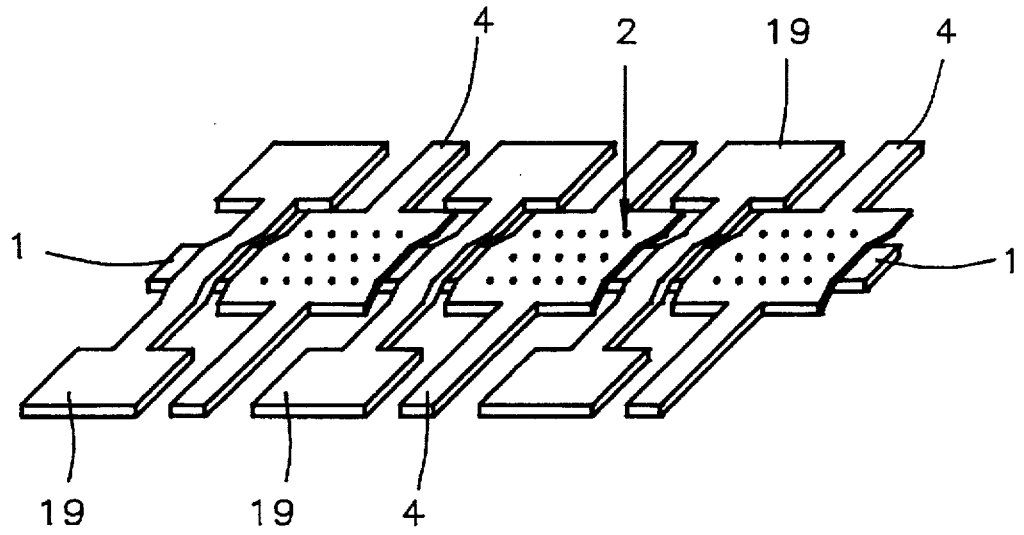
FIG. 4 – Prior Art
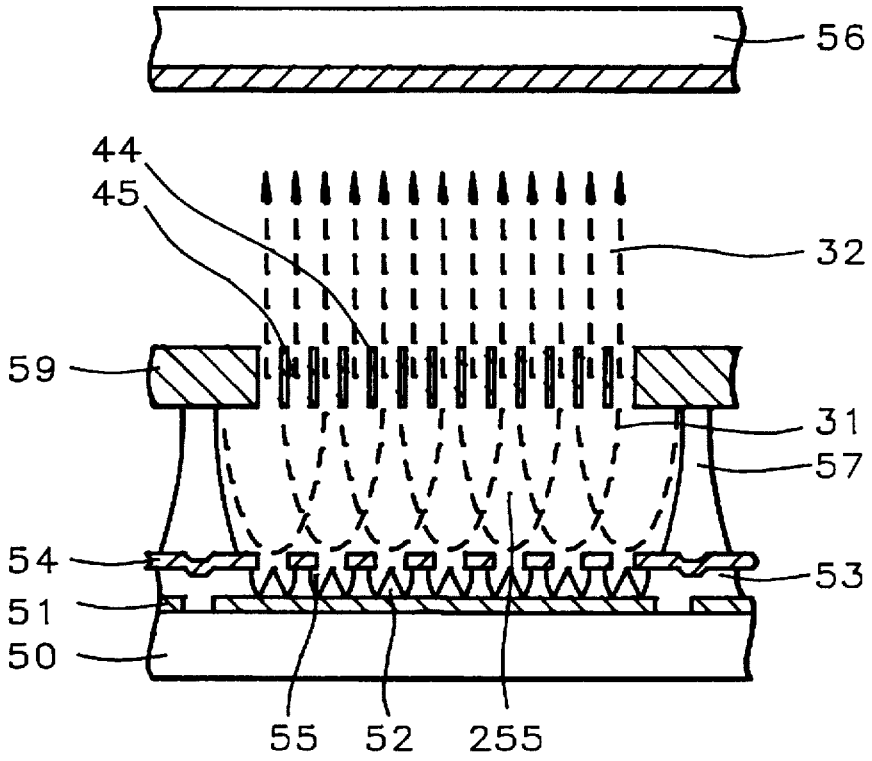
FIG. 5

FIELD EMISSION DEVICE WITH MICROMESH COLLIMATOR

BACKGROUND OF THE INVENTION (1) Field of the Invention

The invention relates to the general field of field emission devices, more particularly to improving the focus of the emitted electron beams.

(2) Description of the Prior Art

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small conical emitters, each of which is connected to a source of negative voltage via a cathode conductor line or column. Another set of conductive lines (called gate lines) is located a short distance above the cathode lines and is orthogonally disposed relative to them, intersecting with them at the locations of the conical emitters or microtips, and connected to a source of positive voltage. Both the cathode and the gate line that relate to a particular microtip must be activated before there will be sufficient voltage to cause cold cathode emission.

The electrons that are emitted by the cold cathodes accelerate past openings in the gate lines and strike an electroluminescent panel that is located a short distance from the gate lines. In general, a significant number of microtips serve together as a single pixel (or subpixel) for the total display. Note that, even though the local electric field in the immediate vicinity of a microtip is in excess of 1 million volts/cm., the externally applied voltage is only of the order of 100 volts.

In FIG. 1 we show, in schematic cross-section, the basic elements of a typical cold cathode display. Metallic lines 1 are formed on the surface of an insulating substrate (not shown). Said lines are referred to as cathode columns. At regular intervals along the cathode columns, microtips 2 are formed. These are typically cones of height about one micron and base diameter about one micron and comprise molybdenum or silicon, though other materials may also be used. In many embodiments of the prior art, local ballast resistors (not shown here) may be in place between the cones and the cathode columns.

Metallic lines 4 are formed at right angles to the cathode columns, intersecting them at the locations of the microtips. A layer of insulation 3 supports lines 4, which are generally known as gate lines, placing them at the top level of the microtips, that is at the level of the apexes of the cones 2. Openings 5 in the gate lines 4, directly over the microtips, allow streams of electrons to emerge from the tips when sufficient voltage is applied between the gate lines and the cathode columns. Because of the local high fields right at the surface of the microtips, relatively modest voltages, of the order of 100 volts are sufficient.

After emerging through the openings 5 in the gate lines, electrons are further accelerated so that they strike fluorescent screen 6 where they emit visible light. Said fluorescent screen is separated from the cold cathode assembly by spacers (not shown) and the space between these two assemblies is evacuated to provide and maintain a vacuum of the order of $10^{-7}$ torr.

It should be noted that, although the electrons are accelerated past the gate (or extraction) electrode, they are also attracted to the gate as they pass it. This arrangement (referred to as proximity focussing) thus leads to the formation of a diverging beam and results in a relatively large spot size at the surface of the phosphor screen.

Several schemes have been proposed for improving on proximity focussing. These have been reviewed by, for example, W. D. Kesling and C. E. Hunt in "Beam focusing for field-emission flat-panel displays" IEEE Trans. Elec. Dev. vol. 42 no. 2 Feb. 1995 pp. 340–347. One such scheme is the introduction of an additional, focusing, electrode similar to the gate electrode but located above it. This is illustrated in FIG. 2 where focus electrode 8 is shown as concentric with and positioned above extraction electrode 4, being separated therefrom by dielectric layer 7. The focus electrode is biased negative relative to the gate (near cathode potential) so that the electron beam, as it passes through it, tends to be compressed and becomes less diverging.

There are two difficulties associated with the focus gate approach. (i) Since electrons are being repelled as they pass through it and because the effectiveness of the gate electrode is reduced by its presence, the focus gate arrangement brings about the requirement of higher gate voltages to achieve the same beam densities. This can cause a problem with breakdown in layer 3. (ii) The requirement that gate and focus electrodes must be precisely aligned relative to one another makes the manufacturing of this arrangement more time consuming and hence more expensive.

A different scheme, the concentric focus, is illustrated in FIG. 3 in isometric projection. Concentric focus electrode 9 is now located in the same plane as extraction electrode 4. This overcomes some of the problems described above but the presence of a concentric focus electrode significantly increases the total area required per microtip, thereby degrading the resolution of the display.

A possible solution to this resolution problem has been proposed by Kesling and Hunt and is illustrated in FIG. 4. In effect, a single concentric focus electrode 19 is provided for an entire group of microtips, such as a subpixel. The problem with this approach is that only a limited improvement in beam focusing can be achieved since the effect of the focus electrode on a given microtip will vary, depending on its location relative to said electrode. This has been reported by C. Py et al. in "In-plane refocusing of a microtip electron beam by a surrounding ring" Tech. Digest Int. Vacuum Microelec. Conf. 1996 pp. 171–175.

SUMMARY OF THE INVENTION

It has been an object of the present invention to provide a color display, based on field emission devices, wherein high resolution, good brightness, and low manufacturing cost are all simultaneously achieved.

Another object of the present invention is to provide a structure in which a parallel electron beam is emitted from each subpixel of the display without diminishing the optical resolution of the display.

Yet another object of the present invention is to provide a structure wherein precise alignment between focusing electrodes and extraction electrodes is not needed for optimum operation of said display.

A still further object of the present invention is to provide a structure wherein the extraction electrodes and the focusing electrodes may be mounted relatively far apart, without reducing the optical resolution of the display.

A final object of the present invention is to provide a process for manufacturing the above described display at a cost that is no greater than that associated with manufacturing similar devices representative of the current state of the art.

These objects have been achieved by providing a structure in which subpixel-sized electron beams are formed by extraction from field emission microtips located on cathode columns over which orthogonally disposed gate lines have been laid. After accelerating past openings in said gate lines, all electrons originating from the same subpixel are made to pass through a single micromesh whose electric potential is more negative than that of the gate. This results in said electrons becoming collimated and forming a parallel beam which diverges only slightly before it reaches the phosphor screen (anode). A process for manufacturing this structure is also provided. Said process does not require that the microtips and the micromesh be carefully aligned nor does the presence of the micromesh lead to any reduction in optical resolution. The problem of minimizing stress in the micromesh is also addressed.

BRIEF DESCRIPTION OF THE DRAWINGS

FIG. I shows the minimum electrode configuration associated with a field emission device.

FIGS. 2 to 4 show more complicated electrode configurations, used in the current art, for achieving improved electron beam focusing.

FIG. 5 is a schematic cross-sectional view of a structure comprising an embodiment of the present invention.

DESCRIPTION OF THE PREFERRED EMBODIMENTS

Figure 6:
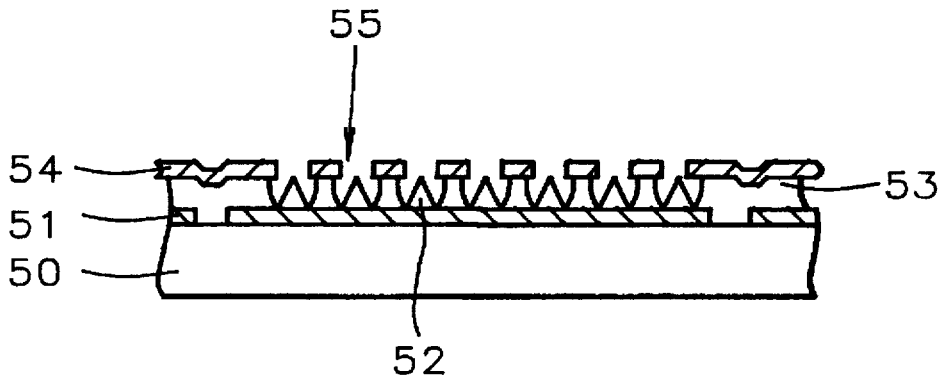
FIGS. 6 to 8 illustrate steps in the manufacturing process, for the structure of FIG. 5, as taught by the present invention.

A structure embodying the present invention is shown, in schematic cross-section, in FIG. 5. Cathode columns 51, comprising spaced parallel conductors (that extend in a direction perpendicular to the plane of the figure), rest on the upper surface of insulating substrate 50. Dielectric layer 53, comprising silicon nitride or silicon oxide, and whose thickness may be between about 0.5 and 2 microns, covers the cathode columns as well as substrate 50 while gate lines 54, running at right angles to cathode columns 51, cover layer 53.

Openings, such as 55, in layer 54 extend through dielectric layer 53 down to the level of cathode layer 51 and are uniformly distributed in an array, numbering between about 4 and 1,000 microtips, over the area of overlap between layers 51 and 54. A microtip, such as 52, is located inside each of said openings. The microtips are, in general, cone shaped, the base of the cone sitting on layer 51 while the apex of the cone is at the level of layer 54. The microtips may comprise molybdenum or silicon.

Dielectric layer 57, comprising silicon oxide or aluminum oxide, and whose thickness may be between about 3 and 10 microns, covers layer 54 except in the area of cavity or opening 255 which overlies the area occupied by the microtips. A metallic layer lies on dielectric layer 57 and has been patterned and etched to form conductive focus lines 59 which just overlie cathode columns 51. The thickness of said focus lines is between about 0.2 and 2 microns and they may comprise molybdenum, niobium, or polysilicon.

Figure 9:
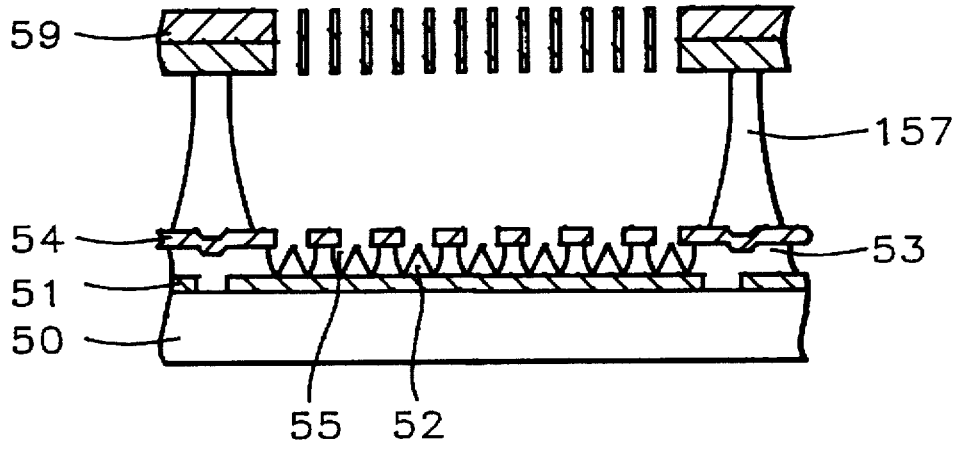
FIG. 9 shows how stress may be minimized in the micromesh component of the present invention.

After formation, the focus lines may be subject to residual stresses (due to expansion mismatch) which could eventually be a source of device failure. In another embodiment of the present invention, stress of this type is neutralized by providing focus lines that comprise two metallic layers, one on top of the other. The upper layer (furthest from the microtips) comprises a material that ends up in tensile stress while the lower layer is one that ends up in compressive stress. The opposing stresses in the two layers cancel one another, rendering micromesh 44 (FIG. 5) stress free. This is illustrated in FIG. 9 where upper layer 159 comprises molybdenum and is between about 0.1 and 1 micron thick while lower layer 259 comprises niobium and is between about 0.1 and 1 micron thick.

Wherever the focus lines overlie the array of microtips, layer 59 extends across opening 255 as a membrane. Holes, such as 45, totalling between about 10 and 1,000 in number, have been formed through said membrane and are uniformly distributed over its surface thereby forming meshed electrode 44. The form and distribution of the holes can take many embodiments. Our preferred embodiment for the holes' shapes has been circular, arranged in a rectangular array, as illustrated in the plan view of mesh electrode 44*a* shown in FIG. 10*a*. Another embodiment that we have used is one of rectangular holes diagonally arranged in brick wall fashion, as illustrated in the plan view of mesh electrode 44*b* in FIG. 10*b*. Examples of other mesh structures (not shown) include rectangular arrays of square shaped holes and rectangular arrays of hexagonal shaped holes. It will thus be understood that any arrangement of holes to form a mesh may be used to accomplish the objects of the present invention without departing from its spirit.

During the operation of the structure shown in FIG. 5, electrons emitted from microtips 55 are extracted by gate line 54 and accelerate through openings 55 into cavity 255 as diverging beam 31. Before they can reach phosphor screen 56 the electrons must pass through holes 45 in meshed electrode 44 which has a potential of about +200 volts relative to cathode layer 54. The electrons then emerge as collimated beam 32 which reaches the surface of phosphor screen 56 with little or no expansion.

Figure 11:
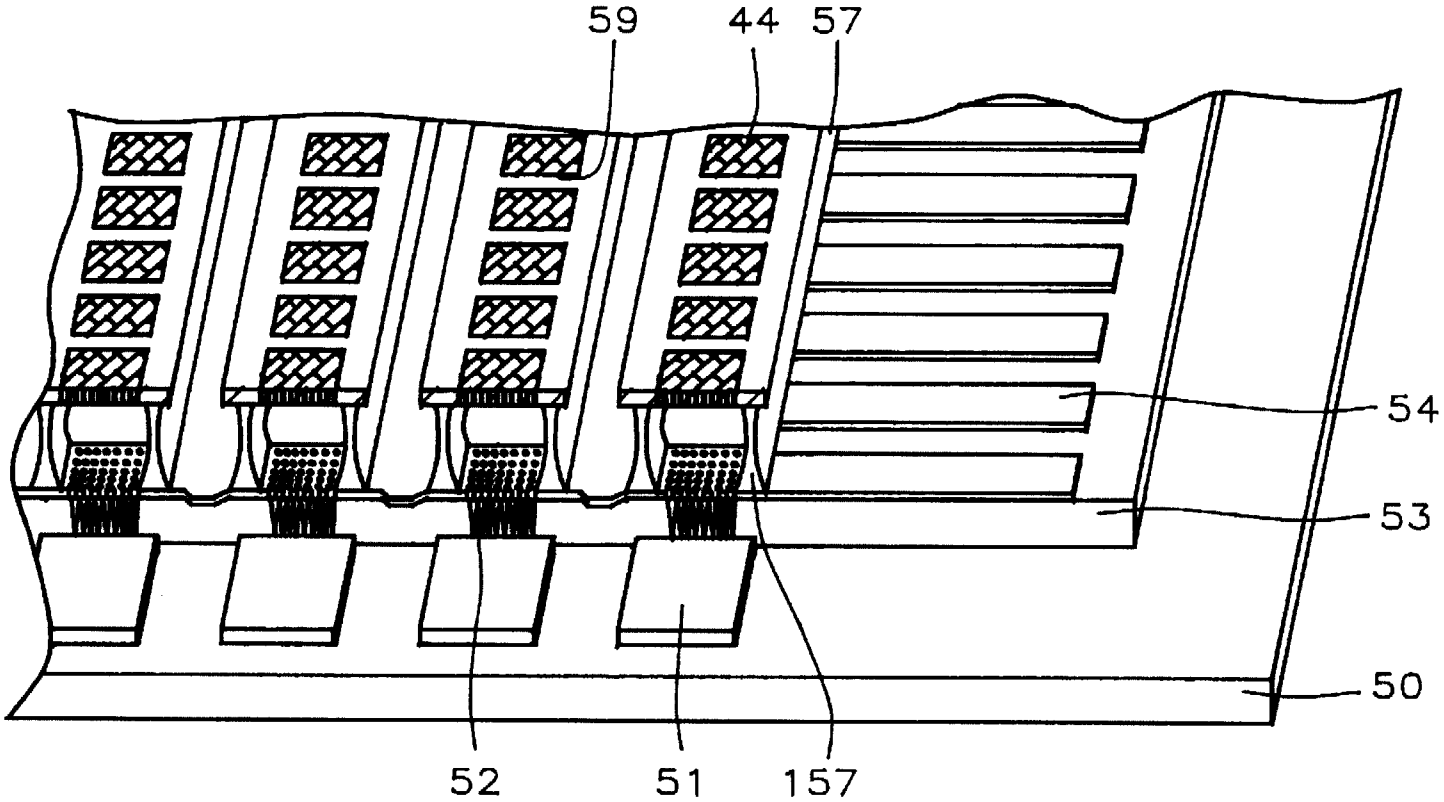
FIG. 11 is an isometric view of the structure of FIG. 5.

The final component shown in FIG. 5 is conductive phosphor screen 56 positioned above, and parallel to, layer 59. Because of the improved parallelism of the electron beam associated with the present invention, the distance between the meshed electrode and the phosphor screen may be anywhere from about 200 microns to about 20 mm. When the separation between these two electrodes is made larger it becomes possible to apply a greater voltage difference between them. This in turn leads to a brighter display. An isometric view of the completed structure (less the phosphor screen) is shown in FIG. 11.

Referring now to FIG. 6, the process for manufacturing the structure shown in FIG. 5 starts with the provision of insulating substrate 50. Cathode columns are formed from metallic layer 51 followed by the deposition of dielectric layer 53 comprising silicon oxide or silicon nitride, to a thickness between about 0.5 and 2 microns. This is followed by the deposition of layer 54 which is formed into gate lines that run perpendicular to the cathode columns. Wherever the cathode columns and gate lines overlap one another an array of openings, such as 55, are formed, said openings extending through layers 54 and 53 down to the top surface of 51. Field emission microtips, such as 52, are then formed, each such microtip being located inside one of the openings. The microtips are, in general, cone shaped, the base of the cone sitting on layer 51 while the apex of the cone is at the level of layer 54.

Figure 7:
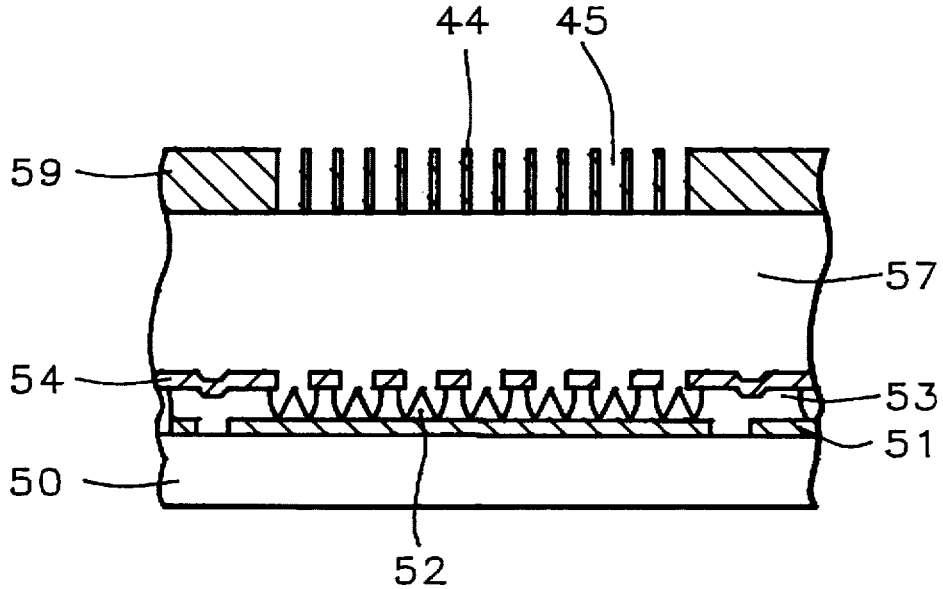

Referring now to FIG. 7, dielectric layer 57, comprising silicon oxide or aluminum oxide is deposited over the entire structure to a thickness between about 4 and 11 microns. It is then planarized, using chemical-mechanical polishing, so that its thickness is reduced to be between about 3 and 10 microns. Metallic layer 59, comprising molybdenum, niobium, or polysilicon, is then deposited onto the newly planarized surface of 57 to a thickness between about 0.2 and 2 microns.

In an alternative embodiment of the process, layer 59 may be formed from two different materials for the purpose of stress reduction, as discussed earlier. First, layer 259 (FIG. 9), comprising niobium, is deposited to a thickness between about 0.1 and 1 microns followed by the deposition of layer 159, comprising molybdenum, to a thickness between about 0.1 and 1 microns.

Figure 10A:
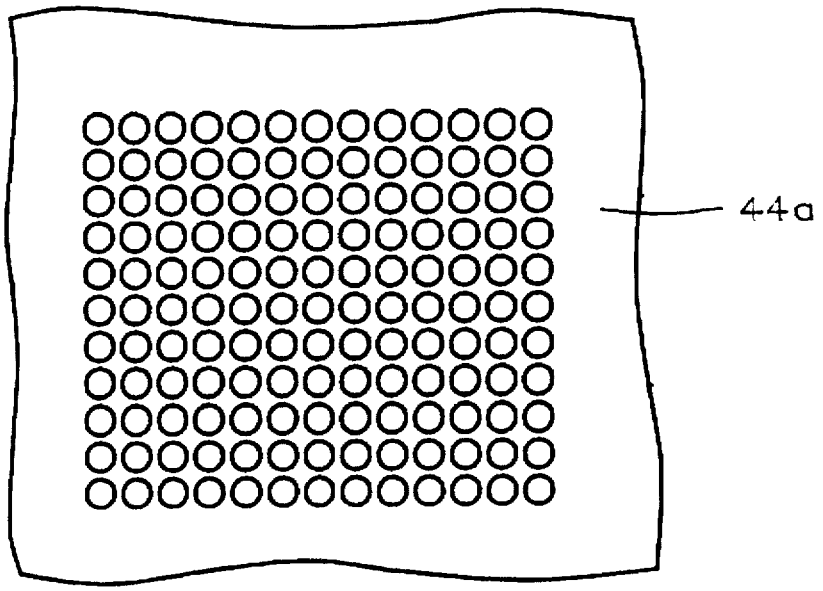
FIGS. 10*a* and 10*b* show examples of micromeshes.
Figure 10B:
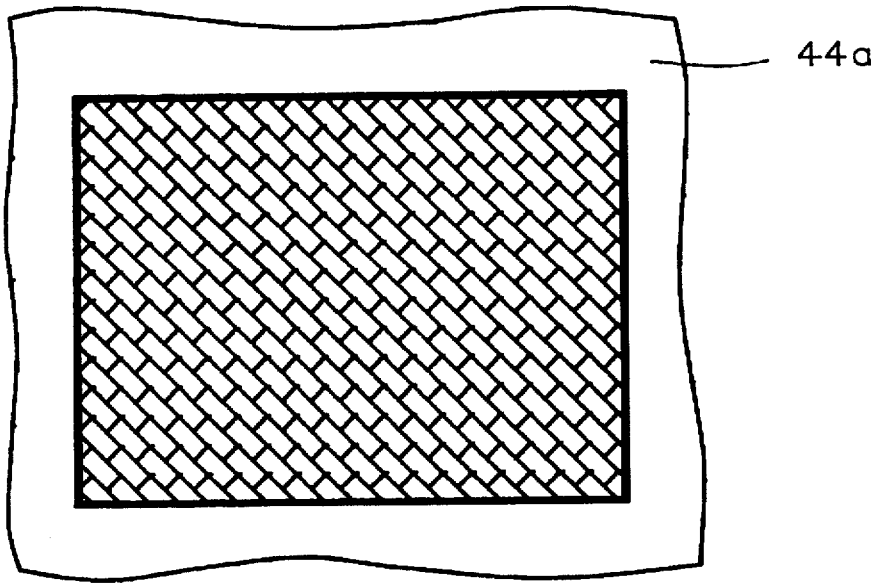

Returning to FIG. 7, layer 59 is now patterned and etched to form focus lines which overlie, as closely as possible, cathode columns 51. Wherever layer 59 passes over an array of microtips it is etched (as part of the same etching step used to form the lines themselves) so that numerous holes, such as 45, are formed. These holes extend to the surface of layer 57 so the appearance of 59 in the areas that overlie the microtips is that of a meshed electrode or micromesh, examples of which are shown in FIGS. 10*a* and 10*b*.

Using the patterned and etched layer 59 as a mask, layer 57 is etched in buffered hydrofluoric acid. This etch is chosen since it will selectively attack the material of layer 57 without attacking any of the other materials present as part of the structure, including layer 53. Overetching is used so that a certain amount of undercutting of layer 59 can occur.

Figure 8:
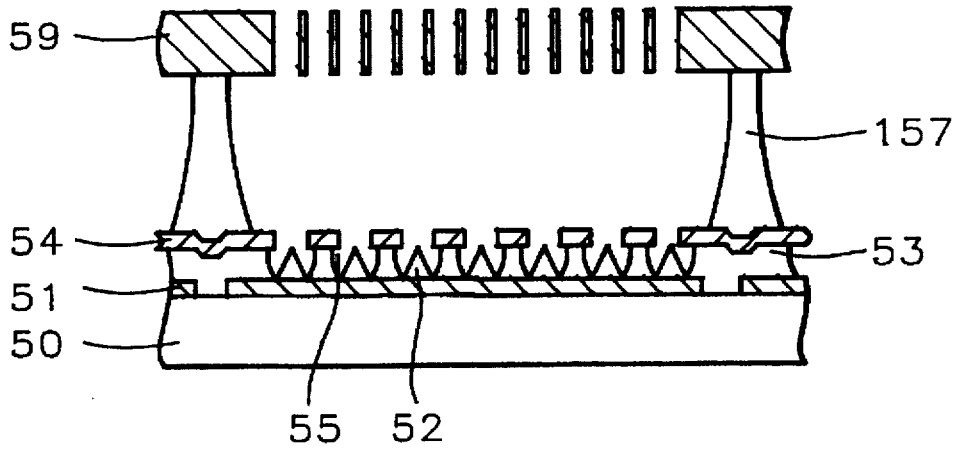

At the conclusion of the above-mentioned selective overetching step, the structure has the appearance shown in FIG. 8. Layer 57 has been completely removed except for the support structures 157. Once the conductive phosphor screen (not shown in FIG. 8) has been permanently positioned above focus lines 59, the process is complete.

While the invention has been particularly shown and described with reference to the preferred embodiments thereof, it will be understood by those skilled in the art that various changes in form and details may be made without departing from the spirit and scope of the invention.

What is claimed is:

1. A cold cathode field emission display comprising:

an insulating substrate;

cathode columns for said display, formed of parallel spaced conductors on said substrate;

a first dielectric layer on said cathode columns;

gate lines on said first dielectric layer, formed of parallel spaced conductors, over and orthogonal to, said cathode columns;

first openings, multiply located at all overlaps of said cathode columns and said gate lines, extending through said gate lines and through said first dielectric layer;

cone shaped field emission microtips on said cathode columns, each microtip being located inside one of said first openings;

a second dielectric layer, on the gate lines;

conductive focus lines, on said second dielectric layer, over said cathode columns;

second openings, in said second dielectric layer, singly located over said overlaps;

meshed electrodes, comprising holes in a membrane, formed from those parts of the focus lines that overlie said second openings; and a conductive phosphor screen located above the focus lines.

2. The structure of claim 1 wherein the thickness of said focus lines is between about 0.2 and 2 microns.

3. The structure of claim 1 wherein said focus lines comprise a material taken from the group consisting of molybdenum, niobium, and polysilicon.

4. The structure of claim 1 wherein said focus lines further comprise:

a layer of niobium, closer to said gate lines; and a layer of molybdenum, further from said gate lines.

5. The structure of claim 1 wherein said holes have a circular shape.

6. The structure of claim 1 wherein said holes have a rectangular shape and are arranged in a brick wall pattern.

7. The structure of claim 1 wherein the thickness of the first dielectric layer is between about 0.5 and 2 microns.

8. The structure of claim 1 wherein the thickness of the second dielectric layer is between about 3 and 10 microns.

9. The structure of claim 1 wherein the number of microtips located within one of said second openings is between 4 and about 1,000.

10. The structure of claim 1 wherein the the number of holes per mesh, located within one of said second openings, is between about 10 and 1,000.

11. The structure of claim 1 wherein said microtips comprise molybdenum or silicon.

12. The structure of claim 1 wherein the distance between said meshed electrodes and said phosphor screen is between about 200 microns and 20 mm.

13. A method for manufacturing a cold cathode field emission display comprising:

(a) providing an insulating substrate;

(b) forming conductive cathode columns on said substrate;

(c) depositing a first dielectric layer on said cathode columns;

(d) forming gate lines on said first dielectric layer, over and orthogonal to, said cathode columns;

(e) forming openings, multiply located at all overlaps of said cathode columns and said gate lines, extending through said gate lines and through said first dielectric layer;

(f) forming cone shaped field emission microtips on said cathode columns, each microtip being located inside one of said first openings;

(g) depositing a second dielectric layer, on said gate lines;

(h) planarizing said second dielectric layer;

(i) depositing a metal layer on said second dielectric layer;

(j) patterning and then etching said metal layer to form focus lines and meshed electrodes;

(k) using said etched metal layer as a mask, selectively overetching said second dielectric layer, thereby entirely removing said second dielectric layer from under said meshed electrodes; and (l) permanently positioning a conductive phosphor screen above said focus lines.

14. The method of claim 13 wherein said first dielectric layer comprises silicon oxide or silicon nitride.

15. The method of claim 13 wherein said second dielectric layer comprises silicon oxide or aluminum oxide.

16. The method of claim 13 wherein the planarizing of the second dielectric layer is achieved by means of chemical mechanical polishing.

17. The method of claim 13 wherein the thickness of the second dielectric layer, after planarizing, is between about 3 and 10 microns.

18. The method of claim 13 wherein the step of selectively overetching said second dielectric layer further comprises etching in buffered hydrofluoric acid.

19. A method for manufacturing a cold cathode field emission display comprising:

(a) providing an insulating substrate;

(b) forming conductive cathode columns on said substrate;

(c) depositing a first dielectric layer on said cathode columns;

(d) forming gate lines on said first dielectric layer, over and orthogonal to, said cathode columns;

(e) forming openings, multiply located at all overlaps of said cathode columns and said gate lines, extending through said gate lines and through said first dielectric layer;

(f) forming cone shaped field emission microtips on said cathode columns, each microtip being located inside one of said first openings;

(g) depositing a second dielectric layer, on said gate lines;

(h) planarizing said second dielectric layer;

(i) depositing a first metal layer on said second dielectric layer;

(j) depositing a second metal layer on said first metal layer;

(k) patterning and then etching said first and second metal layers to form focus lines and meshed electrodes;

(l) using said etched metal layers as a mask, selectively overetching said second dielectric layer, thereby entirely removing said second dielectric layer from under said meshed electrodes; and (m) permanently positioning a conductive phosphor screen above said focus lines.

20. The method of claim 19 wherein said first metal layer comprises niobium deposited to a thickness between about 0.2 and 2 microns.

21. The method of claim 19 wherein said second metal layer comprises molybdenum deposited to a thickness between about 0.2 and 2 microns.

* * * * *